US007106193B2

(12) United States Patent
Kovach

(10) Patent No.: US 7,106,193 B2
(45) Date of Patent: Sep. 12, 2006

(54) INTEGRATED ALARM DETECTION AND VERIFICATION DEVICE

(75) Inventor: John M Kovach, Shoreham, NY (US)

(73) Assignee: Honeywell International, Inc., Morristown, NJ (US)

( * ) Notice: Subject to any disclaimer, the term of this patent is extended or adjusted under 35 U.S.C. 154(b) by 92 days.

(21) Appl. No.: 10/745,765

(22) Filed: Dec. 23, 2003

(65) Prior Publication Data

US 2005/0134450 A1 Jun. 23, 2005

(51) Int. Cl.
*G08B 13/00* (2006.01)

(52) U.S. Cl. ..... 340/541; 340/540; 340/426; 340/506; 340/539.1; 340/539.11; 340/539.16; 340/539.25

(58) Field of Classification Search ..... 340/541, 340/540, 426, 429, 539.1, 937, 539.12, 539.16, 340/539.11, 539.25, 506; 379/37, 42, 43
See application file for complete search history.

(56) References Cited

U.S. PATENT DOCUMENTS 4,857,912 A * 8/1989 Everett et al. ..... 340/508
5,382,943 A * 1/1995 Tanaka ..... 340/539.22
5,448,320 A * 9/1995 Sakai et al. ..... 396/427
6,433,683 B1 * 8/2002 Robinson ..... 340/540
6,658,091 B1 * 12/2003 Naidoo et al. ..... 379/37
2004/0036603 A1 * 2/2004 Bingham ..... 340/541

* cited by examiner

*Primary Examiner*—Tai T. Nguyen
(74) *Attorney, Agent, or Firm*—Anthony R. Barkume, P.C.

(57) ABSTRACT

A security system device including a single housing including at least a primary alarm sensor, an alarm verification unit, and processing circuitry. The primary alarm sensor is adapted to monitor a primary protected area and to generate a primary alarm signal when the primary alarm sensor is triggered. The alarm verification unit selectively provides verification information (e.g. video and/or audio signals) from at least part of the primary protected area to a central station monitor. The processing circuitry is adapted to generate an alarm enable signal when the primary alarm signal is generated. On the occurrence of an alarm enable signal, the processing circuitry generates an alarm detected signal and causes the alarm detected signal to be transmitted to a central station monitor, enables operation of the alarm verification unit, and enables transmission of the verification information from the protected area to the central station monitor. A secondary alarm sensor may also be included within the housing, in which case the alarm enable signal is generated only on the triggering of both the primary and secondary alarm sensors. The primary alarm sensor may be adapted to cause the sensitivity of the secondary alarm sensor to be modified on the triggering of the primary alarm sensor.

39 Claims, 4 Drawing Sheets

INTEGRATED ALARM DETECTION AND VERIFICATION DEVICE

FIELD OF THE INVENTION

This invention relates to security systems, and in particular to a device that integrates alarm event detection and alarm event verification functions in a single housing.

BACKGROUND OF THE INVENTION

Alarm security systems utilize various types of alarm sensor devices mounted in a premises such as a house or business establishment in order to determine if an intruder has breached the premises. As well known in the art, an alarm sensor device will send a signal to a control panel once an intrusion is detected, and the control panel will perform one or more actions, such as sounding a siren and/or transmitting a signal to a central station monitoring service. The central station monitoring service may dispatch security personnel upon receipt of the alarm message from the control panel, for example police or private security personnel may be requested to visit the premises and investigate.

False alarms are sometimes generated by the alarm sensors under certain conditions. These conditions may include environmental occurrences (e.g. a PIR sensor detects a change in temperature in a protected area that is not due to a person entering it) or they may be due to human error (e.g. a homeowner inadvertently setting off the alarm while in the premises). In order to avoid the central station dispatching security personnel unnecessarily as a result of a false alarm, it is desired to be able to utilize an alarm verification process that enables a person at the central station to verify the identity of a person in the protected area of the premises (e.g. to make visual and/or audio contact with the area under surveillance) and make a decision as to whether or not to dispatch security personnel.

Therefore, it is an object of the present invention to provide a security system peripheral device that enables a person at the central station to make visual and/or audio contact with the area under surveillance with an alarm verification unit at the premises and make a judgment as to whether or not to dispatch security personnel.

It is a further object of the present invention to provide such a device that triggers operation of the alarm verification unit only on the occurrence of an alarm condition as detected by an alarm sensor.

It is a further object of the present invention to provide a single housing that integrates the alarm verification technology with the alarm sensor(s) that it is triggered by in order to provide ease of installation.

It is a still further object of the present invention to provide a multi-technology alarm sensing device that substantially reduces the occurrences of false alarms.

It is a still further object of the present invention to provide sensing devices that interact with each other with interactive processing.

It is still further object of the present invention to provide an alarm verification unit that may be alternatively triggered by a person at the premises in the event of a panic situation so that central station personnel may provide aid to the person if required.

SUMMARY OF THE INVENTION

Accordingly, the present invention is a security system peripheral device that is a housing suitable for mounting in a premises. The housing includes at least a primary alarm sensor, an alarm verification unit, and processing circuitry. The primary alarm sensor is adapted to monitor a protected area and to generate a primary alarm signal when the primary alarm sensor is triggered. The alarm verification unit selectively provides verification information (e.g. video and/or audio signals) from at least part of the protected area to a central station monitor.

The processing circuitry is adapted to generate an alarm enable signal when the primary alarm signal is generated. On the occurrence of the alarm enable signal, the processing circuitry generates an alarm detected signal and causes the alarm detected signal to be transmitted to a central station monitor (via a control panel), enables operation of the alarm verification unit, and enables transmission of the verification information from the protected area to the central station monitor.

Thus, once the primary alarm sensor senses an alarm condition (e.g. a glass break sensor determines that a glass break event has occurred or a PIR sensor detects a change in temperature in the protected area, etc.), then the integrated alarm verification unit (which may be a video camera and/or a 2-way voice communications unit) is enabled and the verification information is sent to the central station for analysis by an operator. If the operator, for example, sees an intruder via the video camera at the premises, then he or she may dispatch security personnel accordingly. If the operator sees a person who appears to be the homeowner (he may have an image of the homeowner available for reference), he may utilize the voice capability to ask the person for an identification code and verify that an alarm condition does not exist and that there is no reason to dispatch security personnel.

In another aspect of the invention, the housing may also include a radio frequency (RF) receiver adapted to receive a danger/duress RF signal from an external RF transmitter that may be carried by an authorized user of the premises. The danger/duress RF signal will cause processing circuitry to enable operation of the alarm verification unit and enable transmission of the verification information from the protected area to the central station monitor. This may be used in a panic situation, for example if the homeowner is attacked by an intruder when the alarm system is not enabled and the control panel does not issue an alarm message to the central station.

In another embodiment of the invention, the housing includes a secondary alarm sensor (such as a motion sensor, a magnetic field sensor, and/or an acoustic signal processing device) adapted to monitor at least part of the protected area using an alarm sensing technology different than that of the primary alarm sensor. The secondary alarm sensor generates a secondary alarm signal, and in this case the alarm enable signal is generated only on the occurrence of both the primary alarm signal and the secondary alarm signal. In a further embodiment, the secondary alarm sensor has a variable sensitivity for sensing an alarm condition in the protected area, and the sensitivity of the secondary alarm sensor is adjusted on the occurrence of a primary alarm signal. This dual-technology sensor configuration additionally helps to reduce the occurrences of false alarms.

DETAILED DESCRIPTION OF THE INVENTION

Figure 1:
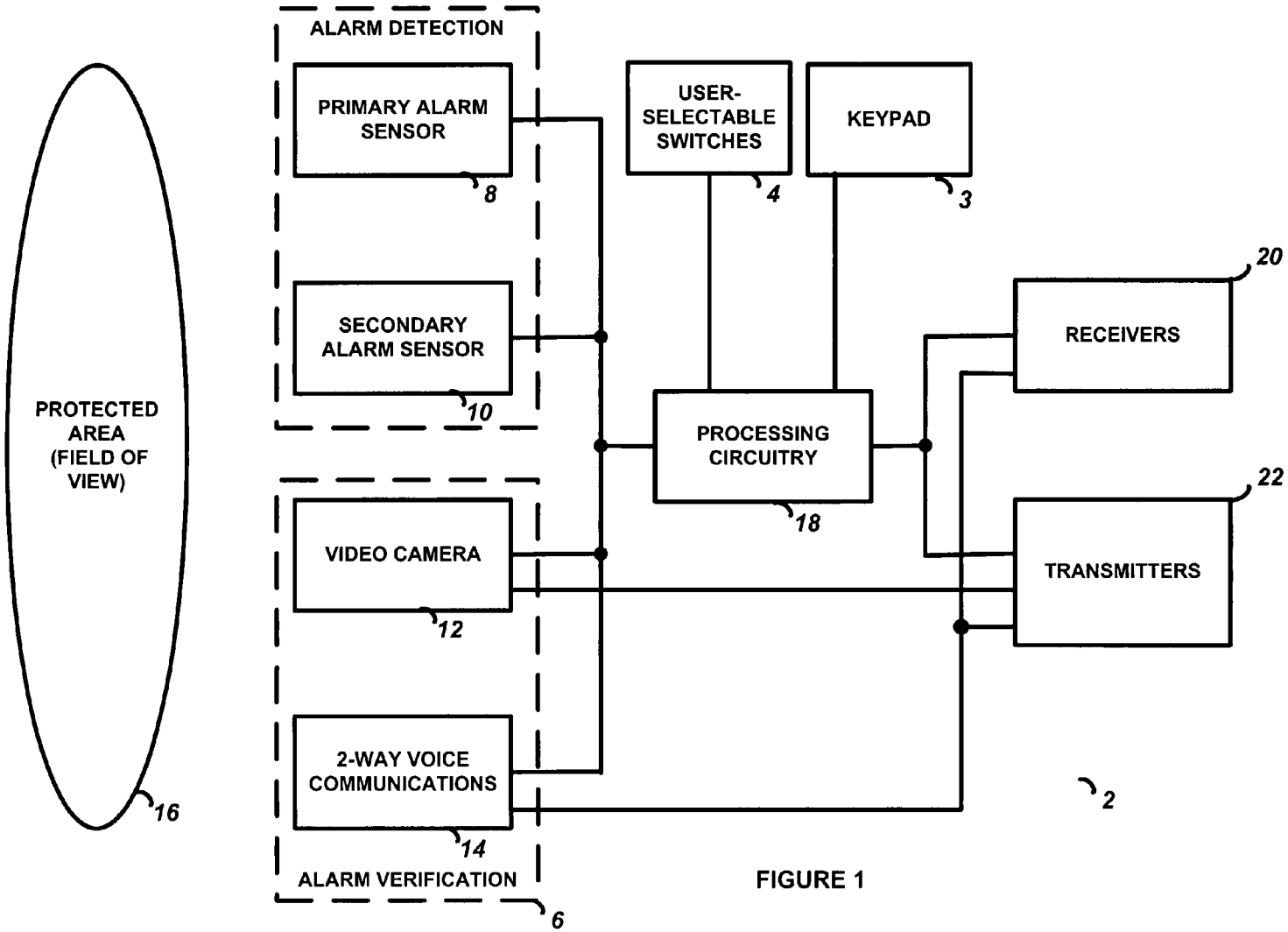
FIG. 1 is a block diagram of the preferred embodiment of the present invention.

The preferred embodiment of the present invention is now described with reference to the Figures. FIG. 1 illustrates a basic block diagram of the integrated alarm detection and verification device 2. The device is integrated into a single housing that is located in a premises such as a house or business establishment in order to monitor a certain protected area or field of view, such as a room, a hallway, an entrance foyer, a lobby, an office, a public restroom, etc. Multiple devices 2 may be installed so as to provide contiguous or partially overlapping coverage of multiple protected areas, such as a long hallway, a large room, etc. The specific location of several devices 2 to provide such extended coverage is a function of the range coverage of the specific alarm sensor technologies employed in the device 2 as described below. Such strategic location of alarm sensors is well known in the art and need not be repeated in detail herein.

Figure 2:
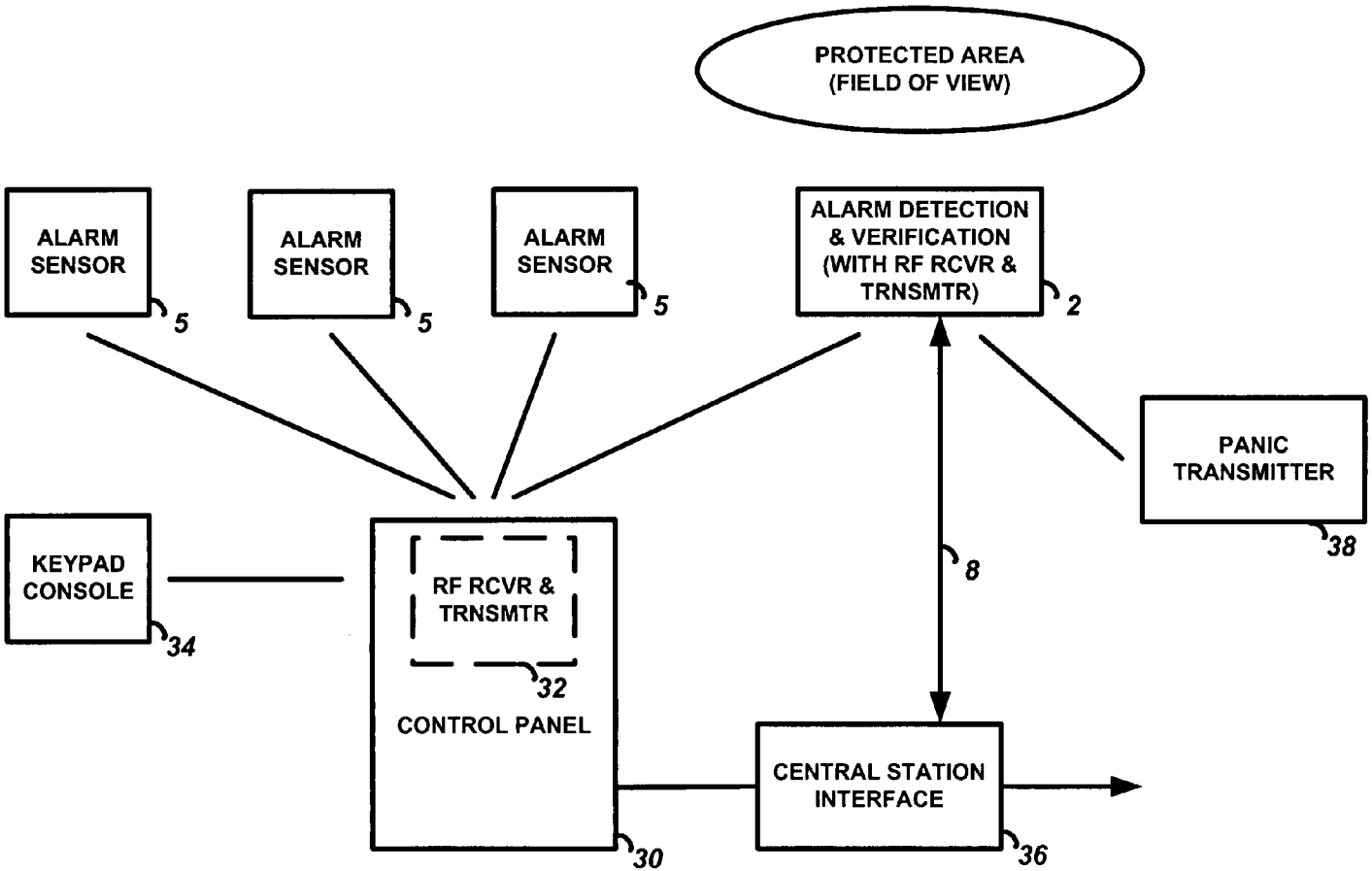
FIG. 2 is a schematic of the alarm system that uses the present invention.

The alarm detection and verification device 2 is interconnected to a security system as well known in the art and as shown in FIG. 2 in order to communicate with other parts of the security system, in particular a control panel 30. The control panel 30 handles master processing functions, such as arming and disarming a system, issuing alarm signals to a central station monitor, etc. The device 2 may communicate with the control panel in a wired bus, or there may be a wireless connection via radio frequency (RF) receivers and transmitters 32 as shown in FIG. 2. Alarm sensors 5, such as PIR sensors, glass break detectors, and the like may also be used in the security system as well known in the art. Interconnection of alarm system components is well known in the art and need not be addressed herein.

Thus, the device 2 will be located so as to monitor a certain protected area. The housing includes several components mounted therein in order to perform the functions of the present invention in a single, easily mountable unit. The housing will include at least one alarm sensor, which is referred to as a primary alarm sensor 8. In the preferred embodiment, the housing will also include a secondary alarm sensor 10, which is usually a different alarm sensing technology than the primary alarm sensor 8 as discussed below. In an alternative embodiment to be discussed below, the housing will have only the primary sensor 8 and the secondary sensor 10 is omitted. However, using a secondary sensor 10 provides certain advantageous features such as reduction in false alarms.

The primary alarm sensor 8 and the secondary alarm sensor 10 may be any of the following alarm sensing technologies: a passive infrared sensor (PIR), a microwave motion sensor, a magnetic field sensing device, a gravitational field sensing device, a glass break detector such as ultrasonic transceiver, or any alarm sensing technology that generates a signal when triggered by some breach of the protected area. In the preferred embodiment, the primary alarm sensor 8 is a PIR sensor and the secondary alarm sensor 10 is a microwave or ultrasonic motion detector, but it is understood that any combination of sensing technologies for the primary and secondary alarm sensors is contemplated by this invention.

The housing also includes an alarm verification unit 6 mounted within or on the outside of the same housing. The function of the alarm verification unit is to provide verification data or feedback to a central station monitor with which the alarm system is in communication. The verification data may be in the form of audio and/or visual information being fed back to a live person at the central station, who can confirm the identity of a person appearing in the protected area by speaking with that person directly or viewing that person. The verification data may also be in the form of fingerprint information or other biometric data that is captured by the alarm verification unit and transmitted back to the central station monitor for automatic analysis and confirmation (with or without human assistance at the central station). As long as some type of information is captured by the alarm verification unit and transmitted to the central station for analysis prior to initiating an alarm condition (and likely dispatching security personnel), the functionality required by the present invention is attained.

For example, in the preferred embodiment, the alarm verification unit 6 is a video camera 12 that monitors the same protected area that is under surveillance by the primary and secondary alarm sensors. The video camera 12 may also have an audio feed so the sounds as well as video information are transmitted back to the central station monitor for analysis.

The third major component of the present invention is processing circuitry 18 as shown in FIG. 1. The processing circuitry 18 may be implemented by a microprocessor, ASIC, dedicated logic and analog circuits, or any combination thereof as well known in the art. The processing circuitry is adapted to control the operation of the alarm detection and verification device by interacting with the primary and secondary alarm sensors, the alarm verification unit 6, and alarm system interface circuits such as data transmitters 22 and receivers 20 that interconnect to the alarm system bus (wired or wirelessly) for communication with the control panel 30 and/or the central station via the alarm system data bus.

Operation of the alarm detection and verification device 2 may be configured by a user (such as a homeowner) to operate in various modes, as will be explained herein. The operating modes and parameters may be set via an alarm system keypad 34, which is interconnected to the alarm system as shown in FIG. 2 as well known in the art. That is, a user may enter appropriate programming codes and instructions into the keypad 34 that will be sent to the alarm detection and verification device 2 (via a unique bus address), which will be interpreted by the device and used to set the user-configurable parameters that are described herein. Other modes of programming the device may be used as well known in the art, such as setting external (or internal) DIP switches and/or pushbuttons 4 and the like.

Figure 3A:
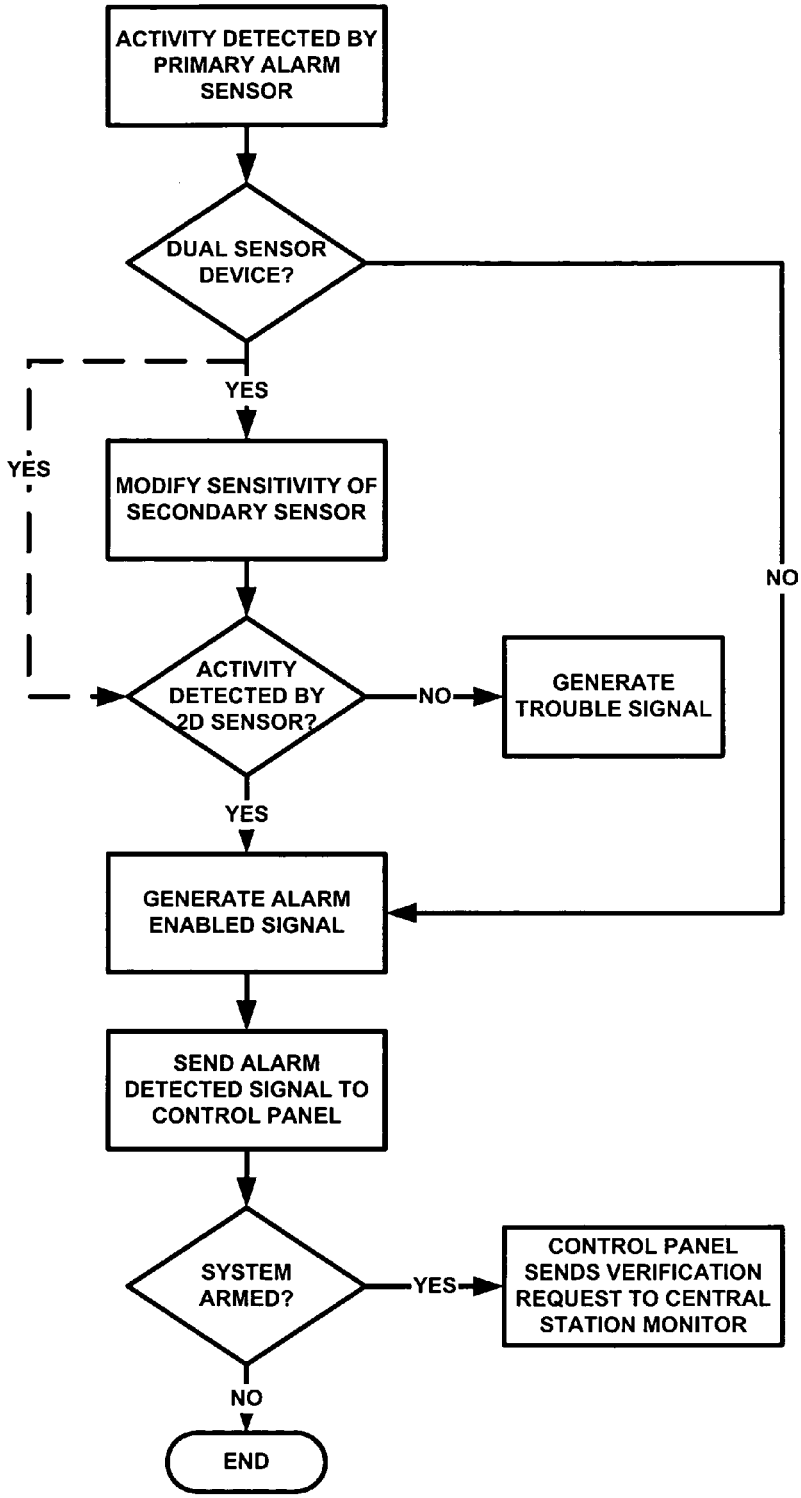
FIGS. 3A and 3B are a flowchart of the operation of the present invention.
Figure 3B:
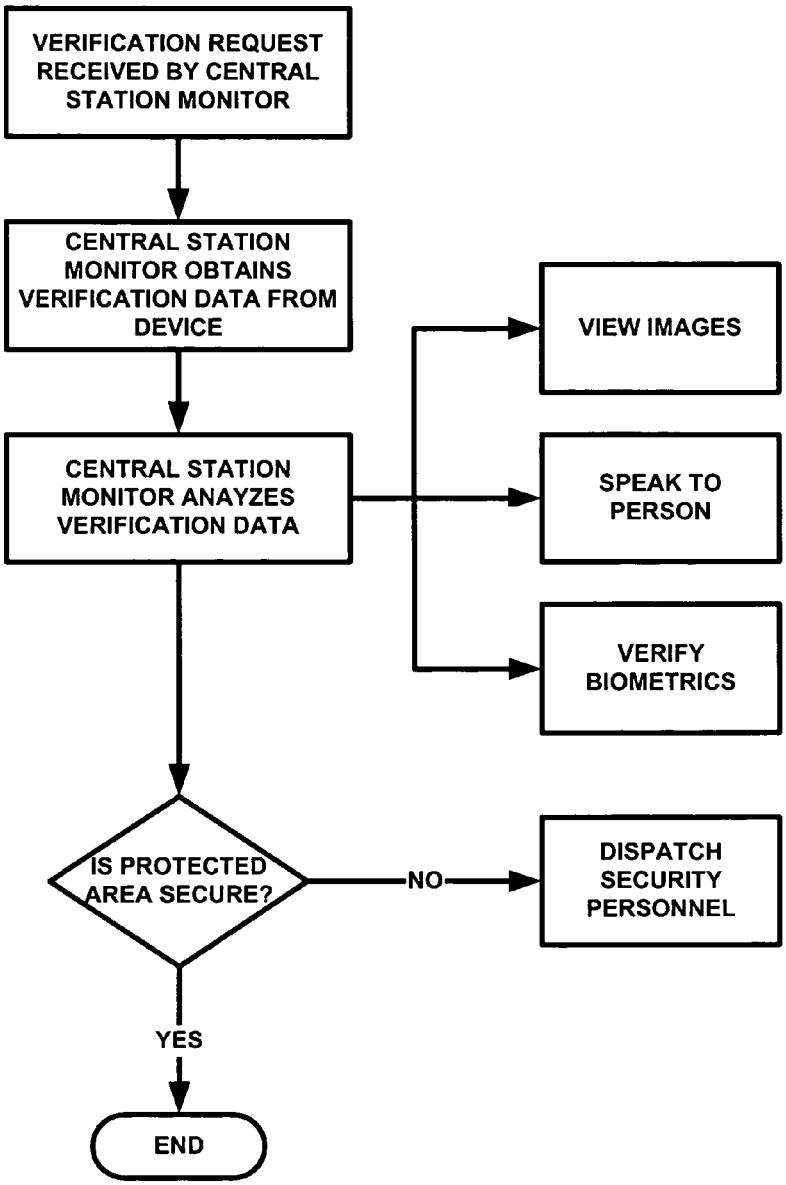

With respect to FIGS. 3A and 3B, in operation, the preferred embodiment utilizes a PIR sensor that is the primary alarm sensor 8 and a microwave or ultrasonic motion detector that is the secondary alarm sensor 10. The initial configuration of the device provides for the microwave motion detector to have a relatively reduced sensitivity. That is, a marginal or borderline activity in the field of view would not set off the microwave motion sensor; it would require a large motion to set it off. When the alarm system is armed, such as when the user has vacated the premises and sets the arm code, then the PIR sensor will generate a PIR Triggered signal when an intruder has entered the field of view of the PIR sensor as well known in the art. The PIR Triggered signal will cause the processing circuitry 18 to increase the sensitivity of the secondary alarm sensor 10 to a level that will readily detect motion in the field of view of the protected area. Assuming that the intruder will now cause the secondary alarm sensor (the motion detector) to detect his or her motion, then the motion detector will generate a Microwave Triggered signal, which is also input to the processing circuitry. When the processing circuitry sees both the Microwave Triggered signal and the PIR Triggered signal (either simultaneously or within a certain time period of each other), then an Alarm Enable signal is generated. If the motion detector does not generate a Microwave Triggered signal, then the Alarm Enable signal will not be generated. This use of multiple alarm sensors acts to decrease the chance of a false alarm. For example, if the PIR sensor is activated by a rise in ambient temperature such as may be caused the building's heat system, then the lack of physical motion in the field of view will result in the microwave motion sensor not triggering and the Alarm Enable signal not (falsely) being generated. In this event, then a Trouble signal may be generated to indicate that only the primary sensor has been triggered.

In the event that an Alarm Enable signal is generated, then an Alarm Detected signal will be generated and subsequently transmitted to the control panel 30 via the data transmitter 22, which will be via a wired connection or a wireless (RF) connection. The control panel 30 will then be adapted to send a Verification Request to the central station monitor via central station interface 36 in a manner well known in the art, such as by dialing the central station over a POTS connection, Internet connection, RF link, etc. In addition, the Alarm Enable signal will cause the alarm verification unit 6 to operate. For example, if the alarm verification unit 6 is a video camera 12, then the video camera will be turned on or otherwise enabled.

Upon receipt of the Verification Request from the premises, the central station monitor will then initiate interactive communications with the alarm detection and verification device in order to verify, in real-time, if an alarm condition truly exists and that security personnel must be dispatched to the premises immediately. In particular, the central station monitor will open a communication channel with the video camera 12 located within the housing in order to receive real-time video (and optionally audio) data captured from the field of view of the camera and optionally to control operation of the camera (i.e. tilt, pan and zoom controls). The central station monitor may control the video camera to view the protected area and make a determination if an intrusion may have occurred. The communication between the central station monitor and the alarm verification unit 6 is effected via the central station interface 36, which may have a direct connection to the verification unit 6 or which may go through the alarm system bus.

In addition to or instead of a video camera, the alarm verification unit may be a two-way voice unit 14 that allows a real-time two-way conversation between the central station monitor and a person in the protected area. Thus, the central station monitor may initiate a conversation and ask the person for an identification code to ensure he or she is authorized to be in the premises. The central station monitor may then make a determination for dispatching security personnel based on the response given by the person in the protected area.

The video and/or audio communications may be implemented by any means known in the art, such as by a real-time feed via the dedicated communications channel 38, or by a digitized data feed such as a packetized data stream that may be transmitted over a private or public switched network such as the Internet, etc. The communications channel may be established directly between the alarm detection and verification device and the central station by wired or wireless means, or it may run through the alarm system data bus and control panel.

In an alternative embodiment, biometric data may be used for verification purposes. For example, a fingerprint reader may be integrated with the housing, and the person in the field of view may be asked to place a finger in the reader so it may capture the fingerprint, digitize the data, and transmit the data to the central station monitor. There, the fingerprint data may be analyzed automatically or manually against a database of authorized users to ensure the person is not an unauthorized intruder. Likewise, voice print or retinal scan data may be captured by the device and sent to the central station for evaluation purposes.

In another alternative embodiment, the central station monitor may request input at the premises of an identification code, which may be entered on a dedicated keypad on the security system bus or on an integral keypad on the housing. Failure to enter the correct code will cause the central station monitor to dispatch security personnel.

As previously mentioned, the device may utilize one or more user-selectable parameters. For example, the user may program the alarm system to only send a Verification Request to the central station monitor when the alarm system is in the "armed away" mode (when the system is fully armed and no one is home), but not when the system is in the "armed stay" mode (when the system is partially armed and someone is home), or it may be programmed to send the Verification Request for both modes.

The alarm detection and verification device may be configured to include an RF receiver 20 adapted to receive "panic" messages from an associated transmitter 38 that may be worn by an authorized user (or carried on a keyfob, a pendant, etc.) By pressing a button or otherwise activating the transmitter, an RF signal will be sent and then received by the RF receiver 20 and cause an Alarm Verification signal to be sent to the central station monitor. This will initiate the personnel verification process as described above. Thus, a person who carries the transmitter may cause a panic alarm by pressing a button on the transmitter such that the central station monitor initiates the verification process. If the central station sees via the video camera that there is an emergency situation, then he or she may dispatch security personnel to the premises. In an alternative embodiment, the panic mode may be caused by a passive device, such as a gravitational or magnetic earth sensor. For example, the wearer of such a transmitter stops moving for a long period of time as detected by the gravitational or magnetic field sensor, then the Alarm Verification signal may be generated and sent to the central station monitor. In this case, the verification may show that the person is lying on the ground (perhaps an elderly or infirm person) and is in need of immediate assistance.

As previously mentioned, the present invention may operate with only a primary alarm sensor 8 in the housing. In this case, triggering of the primary alarm sensor 8 will directly cause the Alarm Enable signal to be generated and a verification request to be made to the central station monitor as described before. In a further embodiment utilizing a primary and a secondary alarm sensor, the processing circuitry may be adapted to provide an Alarm Enable signal on the occurrence of a trigger of either sensor without requiring triggering of both sensors. This may also be a user-selectable feature that may be programmed by the homeowner or system installer.

In a further embodiment, the secondary alarm sensor 10 is an acoustic glass break sensor that includes an acoustical microphone as well known in the art. In the event that the primary alarm sensor is triggered, then a signal is generated that will cause the glass break sensor to act as a microphone for picking up sounds in the protected area, and the sounds will be transmitted to the central station monitor for evaluation. That is, instead of operating solely as a glass break detector, the microphone will become a local "ear" for the central station monitor to listen in on the protected area and make a judgment if security personnel should be dispatched. This may also be part of a two-way voice communications channel, for example if a speaker is utilized to allow the central station monitor to speak with a person in the protected area and listen to his or her responses via the acoustic microphone in the glass break detector.

What is claimed is:

1. A security system peripheral device comprising a single housing suitable for mounting in a premises, said housing comprising:

a) a primary alarm sensor adapted to monitor a primary protected area and to generate a primary alarm signal when said primary alarm sensor is triggered;

b) an alarm verification unit adapted to selectively provide verification information from at least part of the primary protected area to a central station monitor; and c) processing circuitry adapted to (i) generate an alarm enable signal when said primary alarm signal is generated, and (ii) on the occurrence of an alarm enable signal, to:

generate an alarm detected signal and cause the alarm detected signal to be transmitted to a central station monitor; and enable operation of the alarm verification unit;

further comprising a secondary alarm sensor adapted to monitor a secondary protected area using an alarm sensing technology different than that of said primary alarm sensor and to generate a secondary alarm signal, said secondary protected area at least partially overlapping with said primary protected area, wherein said alarm enable signal is generated only on the occurrence of both the primary alarm signal and the secondary alarm signal.

2. The device of claim 1, wherein the processing circuitry is further adapted to enable transmission of the verification information from the protected area to the central station monitor.

3. The device of claim 2 wherein said transmission of the verification information from the protected area to the central station monitor is performed automatically by the device on the occurrence of an alarm enable signal.

4. The device of claim 2 wherein said transmission of the verification information from the protected area to the central station monitor is optionally performed based on a user-selectable parameter.

5. The device of claim 2 wherein said transmission of the verification information from the protected area to the central station monitor is optionally performed based on a status condition of an alarm system with which the device is operating.

6. The device of claim 1 wherein said alarm verification unit comprises a video camera, and further wherein said verification information comprises video information.

7. The device of claim 1 wherein said alarm verification unit comprises a two-way voice communications device, and further wherein said verification information comprises audio information.

8. The device of claim 1 wherein said primary alarm sensor is a motion detector for sensing motion within said protected area.

9. The device of claim 8 wherein said motion detector is a microwave motion detector.

10. The device of claim 8 wherein said motion detector is a passive infrared (PIR) sensor.

11. The device of claim 8 wherein said motion detector is a magnetic field sensing device.

12. The device of claim 8 wherein said motion detector is a gravitational field sensing device.

13. The device of claim 8 wherein said motion detector is an ultrasonic motion detector.

14. The device of claim 1 wherein said primary alarm sensor is a glass break detector for detecting the breakage of glass within said protected area.

15. The device of claim 1 further comprising a radio frequency receiver adapted to receive a danger/duress RF signal from an external RF transmitter, said danger/duress RF signal causing said processing circuitry to:

enable operation of the alarm verification unit; and enable transmission of the verification information from the protected area to the central station monitor.

16. The device of claim 1 wherein said secondary alarm sensor has a variable sensitivity for sensing an alarm condition in the secondary protected area, and wherein the sensitivity of the secondary alarm sensor is adjusted on the occurrence of a primary alarm signal.

17. The device of claim 16 wherein, on the occurrence of only the primary alarm signal and not the secondary alarm signal, a trouble signal is generated and transmitted to a central station monitor.

18. The device of claim 16 wherein the primary alarm sensor is a glass break detector and the secondary alarm sensor is a motion sensor.

19. The device of claim 16 wherein the primary alarm sensor is a motion sensor and the secondary alarm sensor is a glass break detector comprising a microphone, and wherein the motion sensor, when triggered, will cause the microphone to detect sounds in the protected area and transmit said sounds to the central station monitor for evaluation.

20. A method of operating a security system peripheral device contained in a single housing suitable for mounting in a premises, comprising the steps of:

a) monitoring, with a primary alarm sensor, a primary protected area and generating a primary alarm signal when said primary alarm sensor is triggered;

b) generating an alarm enable signal when said primary alarm signal is generated; and c) on the occurrence of an alarm enable signal, generating an alarm detected signal and causing the alarm detected signal to be transmitted to a central station monitor; and enabling operation of an alarm verification unit in the housing, said alarm verification unit adapted to selectively provide verification information from at least part of the primary protected area to a central station monitor;

further comprising the steps of monitoring, with a secondary alarm sensor using an alarm sensing technology different than that of said primary alarm sensor, a secondary protected area, and generating a secondary alarm signal when said secondary alarm sensor is triggered, said secondary protected area at least partially overlapping with said primary protected area;

wherein said alarm enable signal is generated only on the occurrence of both the primary alarm signal and the secondary alarm signal.

21. The method of claim 20, further comprising the step of enabling transmission of the verification information from the protected area to the central station monitor.

22. The method of claim 21 wherein said transmission of the verification information from the protected area to the central station monitor is performed automatically by the device on the occurrence of an alarm enable signal.

23. The method of claim 21 wherein said transmission of the verification information from the protected area to the central station monitor is optionally performed based on a user-selectable parameter.

24. The method of claim 21 wherein said transmission of the verification information from the protected area to the central station monitor is optionally performed based on a status condition of an alarm system with which the device is operating.

25. The method of claim 20 wherein said alarm verification unit comprises a video camera, and further wherein said verification information comprises video information.

26. The method of claim 20 wherein said alarm verification unit comprises a two-way voice communications device, and further wherein said verification information comprises audio information.

27. The method of claim 20 wherein said primary alarm sensor is a motion detector for sensing motion within said protected area.

28. The method of claim 27 wherein said motion detector is a microwave motion detector.

29. The method of claim 27 wherein said motion detector is a passive infrared (PIR) sensor.

30. The method of claim 27 wherein said motion detector is a magnetic field sensing device.

31. The method of claim 27 wherein said motion detector is a gravitational field sensing device.

32. The method of claim 27 wherein said primary alarm sensor is a glass break detector for detecting the breakage of glass within said protected area.

33. The method of claim 27 wherein said motion detector is an ultrasonic motion detector.

34. The method of claim 20 further comprising the step of receiving a danger/duress radio frequency signal from an external RF transmitter, said danger/duress RF signal causing said processing circuitry to:

enable operation of the alarm verification unit; and enable transmission of the verification information from the protected area to the central station monitor.

35. The method of claim 20 wherein said secondary alarm sensor has a variable sensitivity for sensing an alarm condition in the secondary protected area, and wherein the sensitivity of the secondary alarm sensor is adjusted on the occurrence of a primary alarm signal.

36. The method of claim 35 wherein, on the occurrence of only the primary alarm signal and not the secondary alarm signal, a trouble signal is generated and transmitted to a central station monitor.

37. The method of claim 35, wherein the primary alarm sensor is a glass break detector and the secondary alarm sensor is a motion sensor.

38. The method of claim 20 wherein the primary alarm sensor is a motion sensor and the secondary alarm sensor is a glass break detector comprising a microphone, and wherein the motion sensor, when triggered, will cause the microphone to detect sounds in the protected area and transmit said sounds to the central station monitor for evaluation.

39. A security system peripheral device comprising a single housing suitable for mounting in a premises, said housing comprising:

a) a primary alarm sensor adapted to monitor a primary protected area utilizing a first alarm sensing technology and to generate a primary alarm signal when said primary alarm sensor is triggered;

b) a secondary alarm sensor adapted to monitor a secondary protected area utilizing a second alarm sensing technology and to generate a secondary alarm signal, said secondary protected area at least partially overlapping with said primary protected area, said secondary alarm sensor having a variable sensitivity for sensing an alarm condition in the secondary protected area;

c) a video camera unit disposed to monitor a third protected area and generate a video signal representative thereof; said third protected area at least partially overlapping with said primary protected area and said secondary protected area;

d) a two-way voice communications unit; and e) processing circuitry adapted to on the occurrence of a primary alarm signal, then adjust the sensitivity of the secondary alarm sensor;

on the occurrence of both the primary alarm signal and the secondary alarm signal, then generate an alarm detected signal and cause the alarm detected signal to be transmitted to a central station monitor;

enable operation of the video camera unit; whereby the video signal generated by the video camera unit is transmitted to the central station monitor; and enable operation of the two-way voice communications unit.

* * * * *